US009134742B2

(12) United States Patent
Wu

(10) Patent No.: US 9,134,742 B2
(45) Date of Patent: Sep. 15, 2015

(54) VOLTAGE REGULATOR AND VOLTAGE REGULATION METHOD

(75) Inventor: Hsien-Hung Wu, Hsinchu (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 496 days.

(21) Appl. No.: 13/464,198

(22) Filed: May 4, 2012

(65) Prior Publication Data

US 2013/0293209 A1 Nov. 7, 2013

(51) Int. Cl.

| | |
|---|---|
| ***G05F 3/24*** | (2006.01) |
| ***G05F 1/575*** | (2006.01) |
| ***G05F 1/56*** | (2006.01) |
| ***G05F 1/565*** | (2006.01) |

(52) U.S. Cl.
CPC ..... *G05F 1/565* (2013.01)

(58) Field of Classification Search
CPC ..... G05F 3/24; G05F 1/575; G05F 1/56
USPC ..... 323/265, 273, 274, 275, 280
See application file for complete search history.

(56) References Cited

U.S. PATENT DOCUMENTS

| | | | | |
|---|---|---|---|---|
| 5,428,633 | A * | 6/1995 | Hiroshima | 372/38.04 |
| 2005/0143045 | A1* | 6/2005 | Jiguet et al. | 455/343.1 |
| 2006/0170403 | A1* | 8/2006 | Im | 323/280 |
| 2008/0150501 | A1* | 6/2008 | Itoh | 323/273 |
| 2008/0157730 | A1* | 7/2008 | Kim et al. | 323/234 |
| 2010/0066331 | A1* | 3/2010 | Chang et al. | 323/282 |

OTHER PUBLICATIONS

"A Low-Power Microcontroller Having a 0.5-A Standby Current On-Chip Regulator With Dual-Reference Scheme".

* cited by examiner

*Primary Examiner* — Timothy J Dole
*Assistant Examiner* — Sisay G Tiku
(74) *Attorney, Agent, or Firm* — McClure, Qualey & Rodack, LLP

(57) ABSTRACT

A voltage regulator, alternatively operating in an active mode in response to an enabled mode indication signal, and operating in a standby mode in response to the disabled mode indication signal, is provided. The voltage regulator comprises a regulation unit and a feedback circuit. The regulation unit drives an output node with an output signal. The feedback circuit comprises a first resistance unit, connected between the output node and the feedback node, and a second resistance unit. The second resistance unit is connected between the feedback node and a ground reference voltage, and the resistance thereof is scaled down when a mode indication signal is enabled, so as to achieve a level dip event on a feedback signal, and accordingly driving the regulation unit enhancing its drivability of the output signal.

14 Claims, 10 Drawing Sheets

VOLTAGE REGULATOR AND VOLTAGE REGULATION METHOD

BACKGROUND OF THE INVENTION

1. Field of the Invention

The invention relates in general to a voltage regulator and voltage regulation method, and more particularly to a voltage regulator and voltage regulation method configured with standby and active modes.

2. Description of the Related Art

In the present age, electronic devices, such as computers, mobile phones, personal digital assistant (PDA), global positioning system (GPS) navigation devices, and so on, have been developed and wildly accepted across the world. Generally, electronic devices are programmed with multiple operation modes, such as an active mode and a standby mode.

When the electronic devices operate in the active operation, general functions of the electronic devices are executed, so as to have the user provided with the corresponding services. When the electronic devices operate in the standby mode, most power supplies of the electronic devices are turned off. The electronic devices are alternatively switched between the active mode and the standby mode, so as to achieve the object of reducing power consumption thereof.

Generally, power supply solution, employing a voltage regulator with two different amplifiers for respective taking care of powering tasks in standby mode and that in active mode, has been developed. However, present voltage regulators generally suffer from low transition speed as it is switched between the standby and the active modes. As such, how to provide a voltage regulator capable of achieving higher transition speed has became a prominent object for the industries.

SUMMARY OF THE INVENTION

According to a first aspect of the present invention, a voltage regulator, alternatively operating in an active mode in response to an enabled mode indication signal, and operating in a standby mode in response to the disabled mode indication signal, is provided. The voltage regulator comprises an output node, a regulation unit, and a feedback circuit. The regulation unit is coupled to the output node and accordingly drives the output node with an output signal. The feedback circuit, comprises a feedback node, which provides the feedback signal, a first resistance unit, and a second resistance unit. The first resistance unit is connected between the output node and the feedback node, and configured with a first resistance. The second resistance unit is connected between the feedback node and a ground reference voltage, and configured with a second resistance, corresponding to a first value in response to the disabled mode indication signal, and corresponding to a second value, smaller than the first value, in response to the enabled mode indication signal. A level dip event of the feedback signal takes place when the disabled mode indication signal is switched to the enabled mode indication signal due to a sudden resistance decline of the second resistance. The regulation unit enhances drivability of the output signal in response to the level dip event of the feedback signal, so that transition period of the voltage regulator from the standby mode to the active mode is accordingly reduced due to enhanced drivability of the regulation unit and reduced resistance presented on the output node.

According to a second aspect of the invention, a voltage regulation method, applied in a voltage regulator, which alternatively operates in an active mode in response to an enabled mode indication signal, and operates in a standby mode in response to the disabled mode indication signal, is provided. The voltage regulation method comprises the following steps. Firstly, a regulation unit coupled to an output node and accordingly driving the output node with an output signal is provided. Next, a feedback circuit, comprising a feedback node for providing the feedback signal, a first resistance unit, connected between the output node and the feedback node configured with a first resistance, and a second resistance unit, connected between the feedback node and a ground reference voltage and configured with a second resistance, is provided. Then the second resistance is configured as corresponding a first value in response to the disabled mode indication signal. Next, the second resistance is configured as corresponding to a second value, smaller than the first value, in response to the enabled mode indication signal, so that a level dip event of the feedback signal takes place when the disabled mode indication signal is switched into the enabled mode indication signal due to a sudden resistance decline of the second resistance. After that, drivability of the output signal is enhanced in response to the level dip event of the feedback signal by the regulation unit, so that transition period of the voltage regulator from the standby mode to the active mode is accordingly reduced due to enhanced drivability of the regulation unit and reduced resistance presented on the output node.

The invention will become apparent from the following detailed description of the preferred but non-limiting embodiments. The following description is made with reference to the accompanying drawings.

DETAILED DESCRIPTION OF THE INVENTION

First Embodiment

Figure 1:
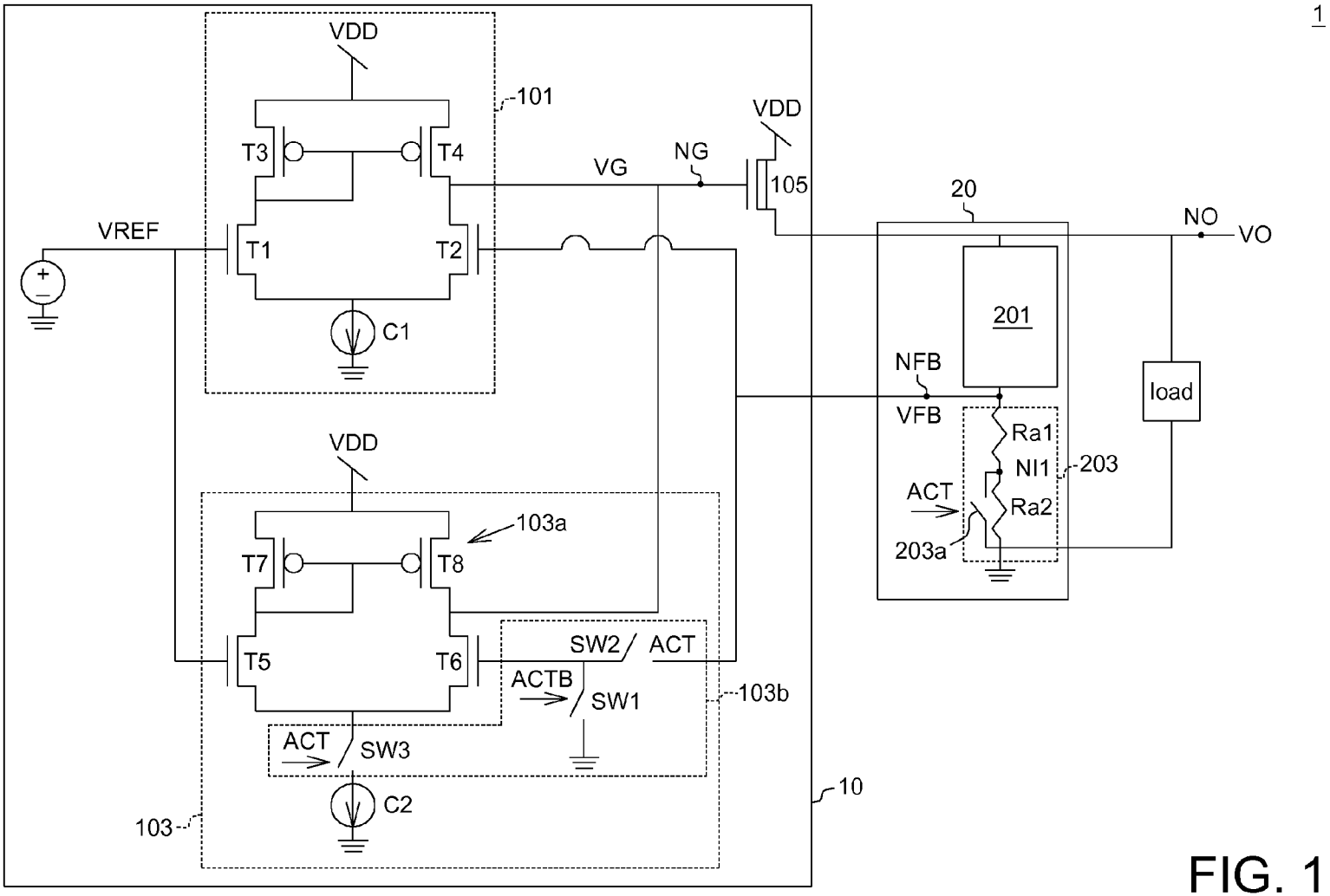
FIG. 1 is a circuit diagram of a voltage regulator according to a first embodiment of the invention.

Referring to FIG. 1, a circuit diagram of a voltage regulator according to a first embodiment of the invention is shown. The voltage regulator 1 is employed in an electronic device for providing an output signal VO capable of powering up the electronic device. For example, the electronic device could be a computer, a mobile phone, table PC, and other kinds of general purpose computer system. In other examples, the electronic device could also be any kinds of internal units, such as a flash memory unit, an IC, and the like of a computer system.

The voltage regulator 1 is configured with an active mode and a standby mode, and the voltage regulator 1 alternatively operates in one of the active and the standby modes in response to a mode indication signal ACT. For example, the voltage regulator 1 operates in the active mode in response to the enabled mode indication signal ACT, e.g. the mode indication signal ACT corresponding to a high signal level, and operates in the standby mode in response to the disabled mode indication signal ACT, e.g. the mode indication signal ACT corresponding to a low signal level.

The voltage regulator 1 includes an output node NO, a regulation unit 10, and a feedback circuit 20, wherein the regulation unit 10 and the feedback circuit 20 are both coupled to the output node NO. The regulation unit 10 drives the output node NO with the output signal VO. For example, when the voltage regulator 1 and the electronic device operate in the standby mode, the regulation unit 10 drives the output node NO with first drivability; when the voltage regulator 1 and the electronic device operate in the active mode, the regulation unit 10 drives the output node NO with second drivability, greater than the first drivability. As such, the regulation unit 10 could selectively drive the electronic device with different drivabilities with reference to the operation mode of the electronic device.

The feedback circuit 20 obtains the feedback signal VFB according to the output signal VO and accordingly feeds the feedback signal VFB back to the input end of the regulation unit 10, so as to form a negative feedback scheme between the input and output ends of the regulation unit 10. The feedback circuit 20 includes a feedback node NFB, a first resistance unit 201, and a second resistance unit 203, wherein the feedback signal VFB is provided from the feedback node NFB.

The first resistance unit 201 is connected between the output node NO and the feedback node NFB, and is configured with a first resistance Rx1.

The second resistance unit 203 is connected between the feedback node NFB and a ground reference voltage, and is configured with a second resistance Rx2. For example, the second resistance unit 203 includes an internal node Nl1, first resistance subunit Rat a switch 203*a*, and second resistance subunit Ra2. The first resistance subunit Ra1 is coupled between the feedback node NFB and the intermediate node Nl1, two ends of the second resistance subunit Ra2 are respectively coupled to the intermediate node Nl1 and receives the ground reference voltage, and the switch 203*a* is coupled across the second resistance subunit Ra2.

The switch 203*a* turns off in response to the disabled mode indication signal ACT. The switch 203*a* further turns on in response to the enabled mode indication signal ACT, and accordingly having two ends of the second resistance subunit Ra2 shorted together. Thus, the second resistance Rx2 corresponds to a first value, i.e. the sum of the first and the second resistance subunits Ra1 and Ra2, in response to the disabled mode indication signal ACT, and corresponds to a second value, i.e. the resistance of the first resistance subunit Ra1, in response to the enabled mode indication signal ACT, wherein the second value is smaller than the first value.

Figure 2:
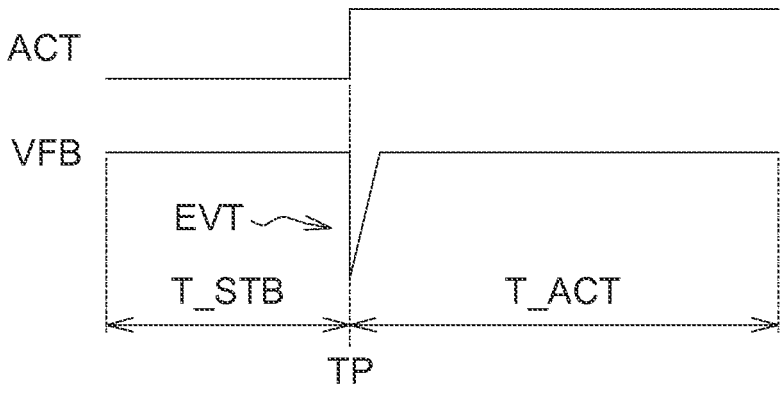
FIG. 2 is a timing diagram of the voltage regulator 1.

Referring to FIG. 2, a timing diagram of the voltage regulator 1 is shown. For example, the operation of the voltage regulator 1 is segmented in to a standby period T_STB and an active period T_ACT with a rising edge of the mode indication signal ACT, which is triggered at a time point TP.

In the standby period T_STB, the mode indication signal ACT corresponds to the low signal level, i.e. is disabled, so that the voltage regulator 1 and the electronic device accordingly operate in the standby mode. Besides, the switch 203*a* turns off in response to the disabled mode indication signal ACT, so that the second resistance Rx, corresponding to the resistance value of the sum of the first and the second resistance subunits Ra1 and Ra2, is presented between the feedback node NFB and the ground reference voltage.

As the rising edge of the mode indication signal ACT is triggered at the time point TP, the mode indication signal ACT is switched from the low signal level to the high signal level, i.e. is enabled, so that the voltage regulator 1 and the electronic device accordingly are switched from the standby mode to the active mode. Besides, the switch 203*a* turns on in response to the enabled mode indication signal ACT, so that the second resistance Rx2, switched as being corresponding to the resistance value of the second resistance subunit Rat is presented between the feedback node NFB and the ground reference voltage. In other words, the second resistance Rx2 suddenly declines as the rising edge of the mode indication signal ACT is triggered. Consequently, a level dip event EVT of the feedback signal VFB, due to the sudden resistance decline of the second resistance Rx2, takes place right after the rising edge of the mode indication signal ACT is triggered.

Since the feedback circuit 20 substantially forms a negative feedback, the level dip event EVT of the feedback signal VFB accordingly is recognized by the regulation unit 10 as a sign that the output node NO lacks sufficient drivability. The regulation unit 10 thus drastically enhances its drivability of the output signal VO in response to the level dip event EVT of the feedback signal VFB. Besides, the resistance presented on the output node NO is also drastically reduced due to the switching operation of the switch 203*a*. Consequently, the transition time, needed for the voltage regulator switching from the standby mode to the active mode, is significantly reduced due to the enhanced drivability of the regulation unit 10 and the reduced resistance presented on the output node NO.

In the active period TACT, the mode indication signal ACT corresponds to the high signal level, i.e. is enabled, so that the voltage regulator 1 and the electronic device accordingly operate in the active mode. Besides, the switch 203*a* turns on in response to the enabled mode indication signal ACT, so that the second resistance Rx, corresponding to the resistance value of the first resistance subunit Rat is presented between the feedback node NFB and the ground reference voltage. Consequently, the voltage regulator 1 accordingly drives the electronic device with the resistance presented on the output node NO reduced.

Based on the above, the voltage regulator 1 according to the present embodiment of the invention is capable of achieving lowered transition time, i.e. enhanced transition speed, by means of employing the resistance switchable feedback circuit 20.

In an example, the regulation unit 10 includes a drive node NG, a secondary amplifier 101, a primary amplifier 103, and an output driver 105. The secondary amplifier 101 is configured with the first drivability for driving the drive node NG in response to a feedback signal VFB. For example, the secondary amplifier 101 is implemented with a differential amplifier, wherein the input ends and output ends of the differential amplifier respective receive the feedback signal VFB and a reference signal VREF, and the output node of the differential amplifier is coupled to the drive node NG. The secondary amplifier 101 drives the drive node NG with a drive signal VG according to the difference of the feedback signal VFB and the reference signal VREF. For example, the differential amplifier is implemented with transistors T1 to T4, and bias current source C1.

The primary amplifier 103 is configured with the second drivability for driving the drive node NG according to the feedback signal VFB in response to the enabled mode indication signal ACT. In other words, the primary amplifier 103 is a much powerful driving circuit employed for taking care of the driving task in the active mode. The primary amplifier 103 accordingly consumes more power than the secondary amplifier 101, and is thus disabled in the standby mode.

For example, the primary amplifier 103 is implemented with a differential amplifier unit 103*a* and switch unit 103*b*. The differential amplifier unit 103*a* is biased with a quiescent current higher that that of the secondary amplifier 101. The switch unit 103*b* has the differential amplifier unit 103*a* coupled to the drive node NG in response to the enabled mode indication signal ACT, and has the differential amplifier unit 103*a* disabled in response to the disabled mode indication signal ACT. For example, the differential amplifier unit 103*a* is implemented with transistors T5 to T8, and bias current source C2, and the switch unit 103*b* is implemented with switches SW1 to SW3, wherein the inversed mode indication signal ACTB is obtained by applying inversion operation on the mode indication signal ACT.

The output driver 105 is coupled to the drive node NG and is driven by the drive signal VG on the drive node NG to provide the output signal VO on the output node NO. For example, the output driver 105 is implemented with an N-channel MOSFET power transistor.

Second Embodiment

Figure 3:
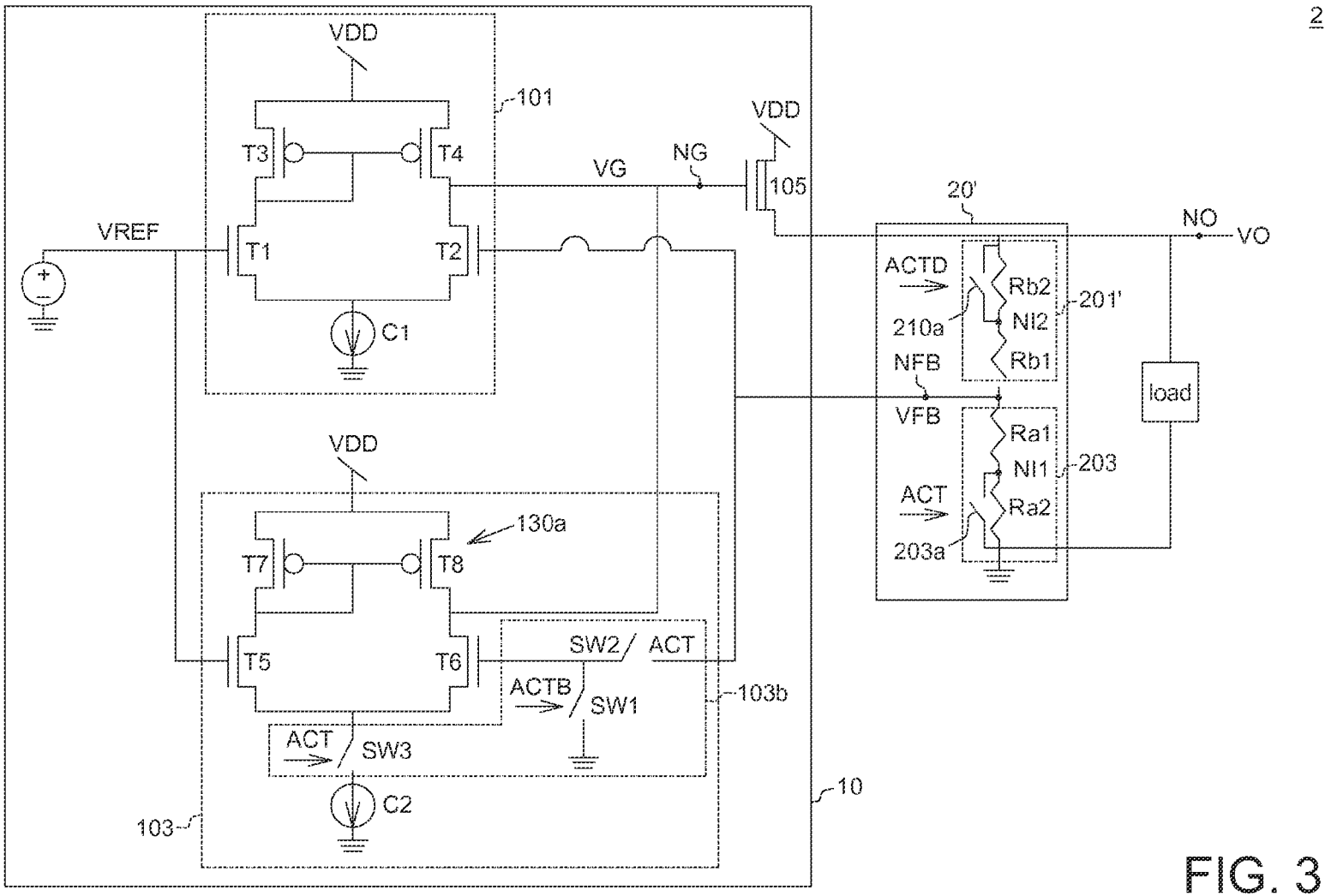
FIG. 3 is a circuit diagram of a voltage regulator according to a second embodiment of the invention.

Referring to FIG. 3, a circuit diagram of a voltage regulator according to a second embodiment of the invention is shown. The voltage regulator 2 illustrated in FIG. 3 is different from that illustrated in the first embodiment in that the first resistance unit 201' is also provided with a similar resistance switch scheme of the second resistance unit 203. In other words, the resistance presented between the output node NO and the feedback node NFB can also be selectively switched.

In detail, the first resistance unit 201' includes an intermediate node Nl2, a third resistance subunit Rb1, a fourth resistance subunit Rb2, and a switch 201*a*. The third resistance subunit Rb1 is coupled between the intermediate node Nl2 and the feedback node NFB, the fourth resistance subunit Rb2 is coupled between the output node NO and the intermediate node Nl2, and the switch 201*a* is coupled across the fourth resistance subunit Rb2. The switch 201*a* operates in response to a control signal ACTD.

For example, the control signal ACTD is obtained by applying delay operation on the mode indication signal ACT. In other words, the control signal ACTD is obtained by having the mode indication signal ACT delayed for a delay period. The delay period can be determined according to the resistance and the capacitance presented on the output node NO. In a practical example, the maximum value of the delay period TPd_max is determined as:

$$TPd_max=C_{load}\times(Ra1+Rb1),$$

wherein $C_{load}$ is the equivalent capacitance presented on the output node NO, e.g. the output capacitance presented between the output node NO and the ground reference voltage; Ra1 and Rb1 respectively correspond to the resistance values of the first resistance subunit Ra1 and third resistance subunit Rb1.

The switch 201*a* turns off in response to the disabled mode control signal ACTD. The switch 201*a* further turns on in response to the enabled control signal ACTD, and accordingly having two ends of the fourth resistance subunit Rb2 shorted together. Thus, the first resistance Rx1' corresponds to a third value, i.e. the sum of the third and the fourth resistance subunits Rb1 and Rb2, in response to the disabled control signal ACTD, and corresponds to a fourth value, i.e. the resistance of the third resistance subunit Rb1, in response to the enabled control signal ACTD, wherein the fourth value is smaller than the third value.

Figure 4:
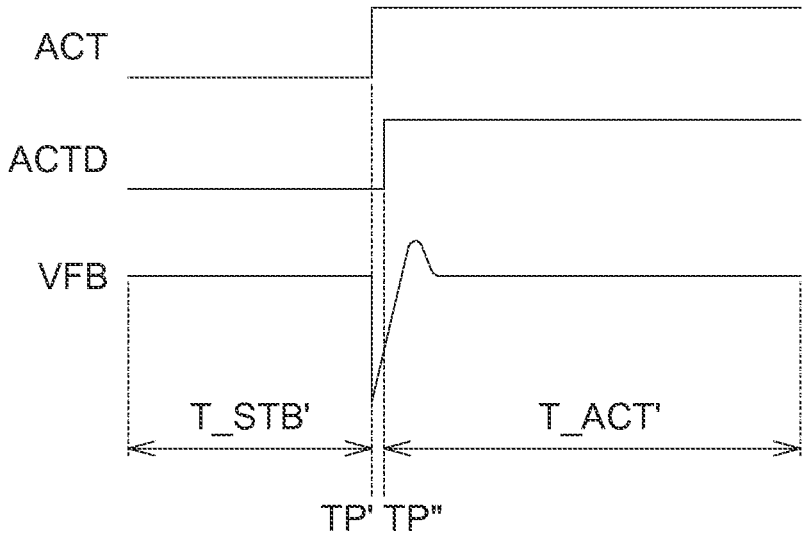
FIG. 4 is a timing diagram of the voltage regulator 2.

Referring to FIG. 4, a timing diagram of the voltage regulator 2 is shown. The operation of the voltage regulator 2 is different from that of the voltage regulator 1 in that the control signal ACTD, whose rising edge is triggered at time point TP", is involved. Since the operation of the voltage regulator 2 in the standby period T_STB', the act period T_ACT', and at the time point TP' are substantially the same as that in the standby period T_STB, the active period T_ACT, and at the time point TP illustrated in FIG. 2, the corresponding description is accordingly omitted for the sake of conciseness of the specification.

As the rising edge of the control signal ACTD is triggered at the time point TP", the control signal ACTD is switched from the low signal level to the high signal level, i.e. is enabled, so that the switch 201*a* turns on in response to the enabled control signal ACTD, and the first resistance Rx1, switched as being corresponding to the resistance value of the third resistance subunit Rb1, is presented between the output node NO and the feedback node NFB. In other words, the sum of the first resistance Rx1 and the second resistance Rx2 at time point TP" declines as the rising edge of the control signal ACTD is triggered and the resistance presented between the feedback node VFB and the output node NO is even smaller than that at the time point TP'. Consequently, more current flowing into feedback network 20' and producing a faster rise event of the feedback signal VFB, due to the sudden decline of the sum of the first resistance Rx1 and the second resistance Rx2, takes place right after the rising edge of the control signal ACTD is triggered.

Based on the above, the voltage regulator 2 according to the present embodiment of the invention is capable of achieving lowered transition time, i.e. enhanced transition speed, by means of employing the resistance switchable feedback circuit 20'.

Figure 5:
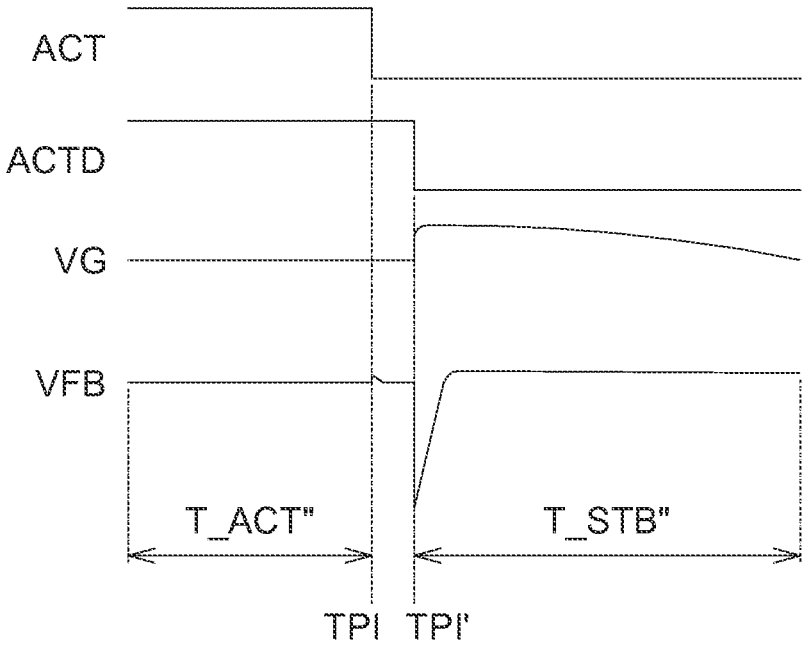
FIG. 5 is a timing diagram of the voltage regulator 2.

Referring to FIG. 5, a timing diagram of the voltage regulator 2 is shown. The voltage regulator 2 also switches back from the active mode back to the standby mode in response to the failing edge of the mode indication signal ACT, which is triggered at a time point TPI, wherein the falling edge of the control signal ACTD is accordingly triggered at a time point TPI', after the time point TPI.

When the falling edge of the mode indication signal ACT is triggered at the time point TPI, the mode indication signal ACT is switched from the high signal level to the low signal level, i.e. is disabled, so that the switch 203*a* turns off in response to the disabled mode indication signal ACT, and the second resistance Rx2, switched as being corresponding to the resistance value of the sum of the first and the second resistance subunits Ra1 and Ra2, is presented between the feedback node NFB and the ground reference voltage. In other words, the second resistance Rx2 increases as the falling edge of the mode indication signal ACT is triggered. Consequently, a level rise event of the feedback signal VFB, due to the sudden increase of the second resistance Rx2, takes place right after the falling edge of the mode indication signal ACT is triggered.

When the falling edge of the control signal ACTD is triggered at the time point TPI', the control signal ACTD is switched from the high signal level to the low signal level, i.e. is disabled, so that the switch 201*a* turns off in response to the disabled control signal ACTD, and the first resistance Rx1, switched as being corresponding to the resistance value of the sum of the third and the fourth resistance subunits Rb1 and Rb2, is presented between the output node NO and the feedback node NFB. In other words, the resistance of the first resistance Rx1 rises as the falling edge of the mode indication signal ACT is triggered. Consequently, a level falling event of the feedback signal VFB, due to the sudden resistance increase of the first resistance Rx1 takes place right after the falling edge of the control signal ACTD is triggered.

Besides, the drive signal VG is accordingly raised right after the falling edge of the control signal ACTD due to the level falling event of the feedback signal VFB. The raised drive signal VG correspondingly drives the output driver 105 applying more drivability on the output node NO, so that the output signal VO is wrongly charged up. What is even worse is that the voltage regulator 2 has already entered the standby mode, such that the primary amplifier 103 is already disabled and the secondary amplifier 101 is the only drive force for pulling down the wrongly raised drive signal VG and the output signal VO. Consequently, the switch operations of the feedback circuit 20' results in a prolongated transition time, i.e. a slow transition speed, of the voltage regulator 2 when it switches from the active mode to the standby mode.

Figure 6:
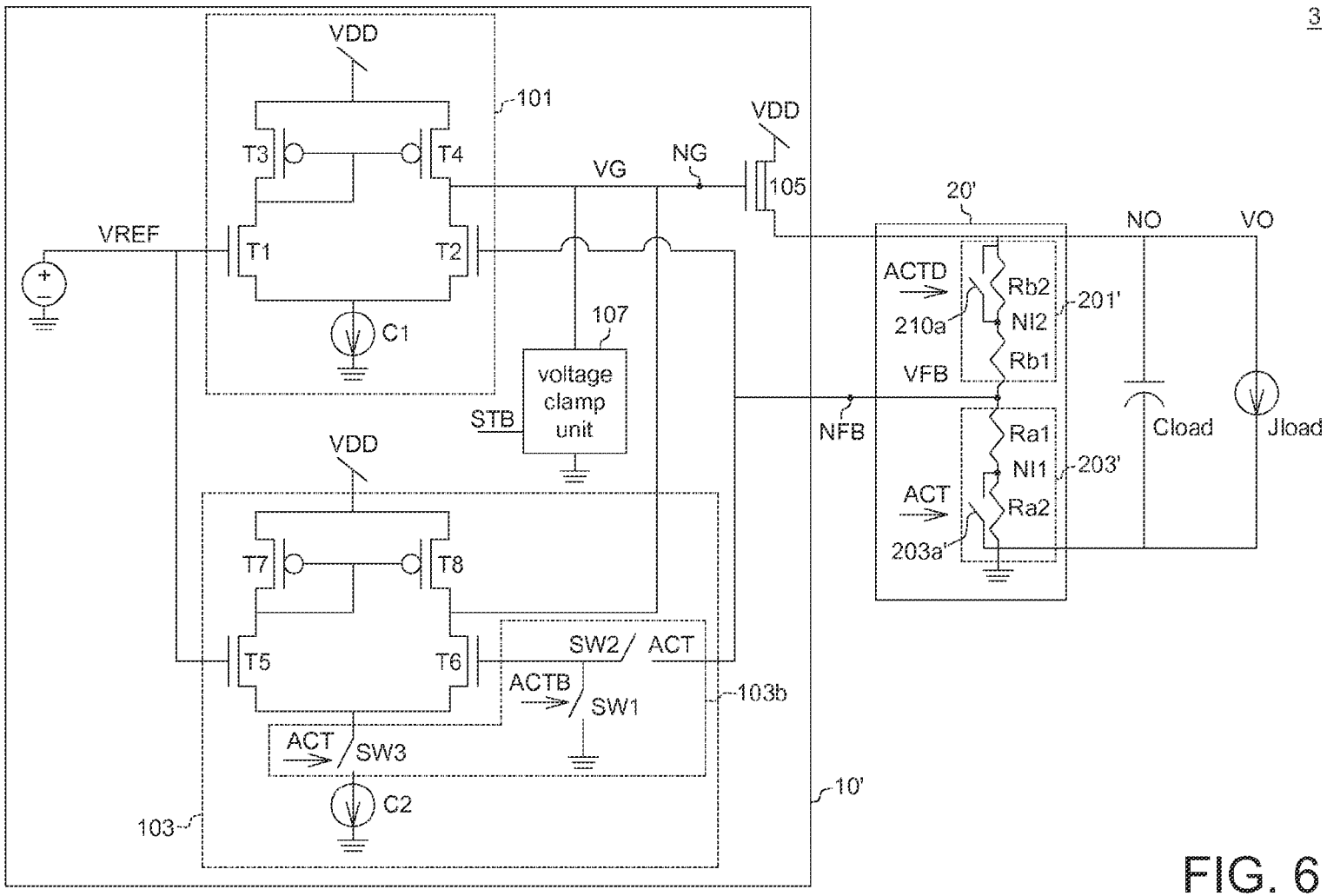
FIG. 6 is a circuit diagram of a voltage regulator according to a second embodiment of the invention.

In order to remedy the above situation, the voltage regulator 3 according to the present embodiment of the invention could further employ a voltage clamp unit 107 for having the drive signal VG clamped when it is going to be wrongly raised at the time point TPI', as illustrated in FIG. 6. For example, the voltage clamp unit 107 is coupled to the drive node NG, and for having the drive signal VG on the drive node NG clamped within a boundary voltage BV, wherein the boundary voltage BV is set in such a way for having the output driver 105 biased as being barely on. For example, when the output driver 105 is biased as being barely on, the output driver 105 is driven by the clamped drive signal VG in such a way that the output driver 105 is turned on, but with limited current drivability.

Figure 7:
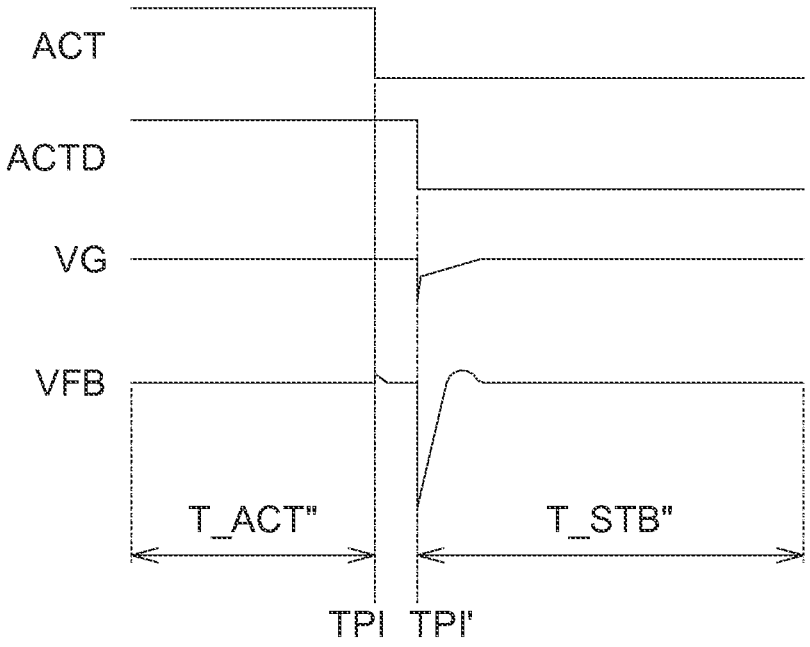
FIG. 7 is a timing diagram of the voltage regulator 2.

Consequently, the drive signal VG is clamped within the boundary voltage BV, and the level of the output signal VO is also properly limited when the falling edge of the control signal ACTD is trigged, as illustrated in FIG. 7.

Figure 8:
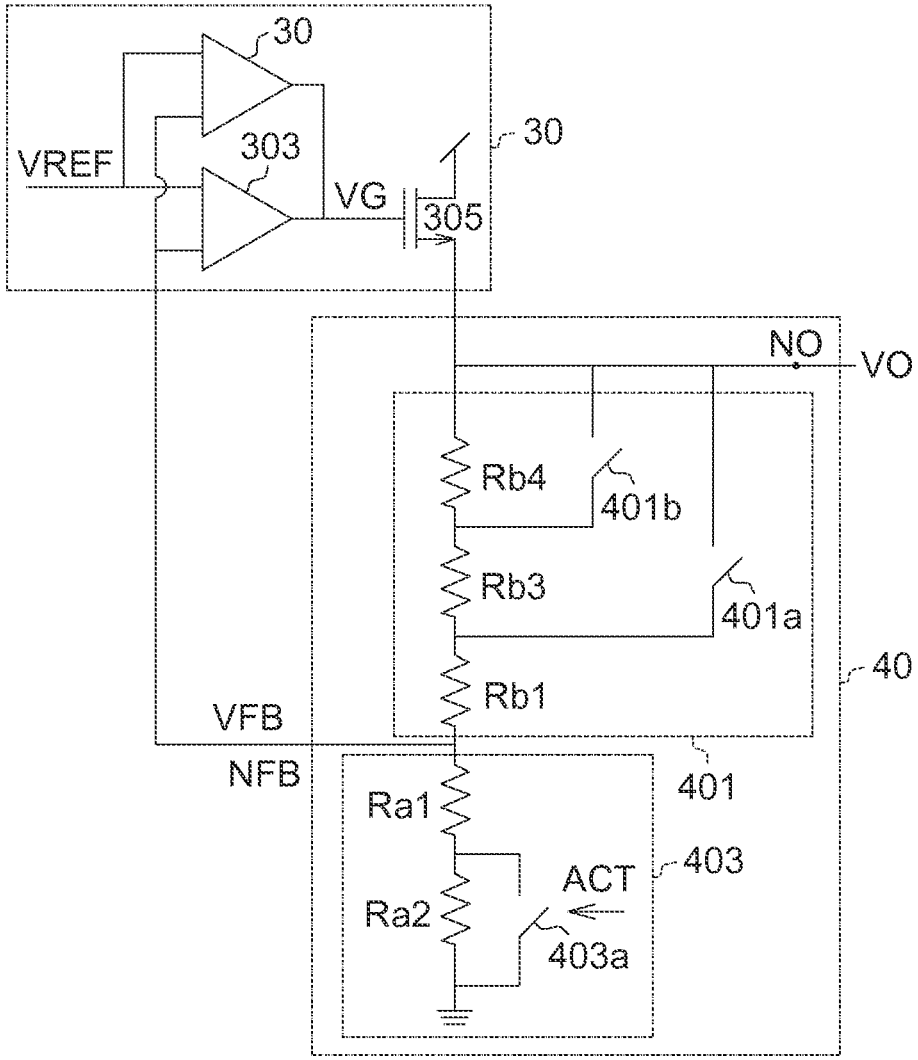
FIG. 8 is a circuit diagram of a voltage according to the present embodiment of the invention.

Though only the situation that the voltage regulator is implemented as the circuit diagram of FIG. 3 and FIG. 6 are cited in the present embodiment of the invention, the voltage regulator is not limited thereto. In other example, the first resistance unit 401 of the feedback circuit 40 can also be designed to incorporate more switches and more resistance subunits, so that the output signal VO can also be selectively biased with different levels, as shown in FIG. 8. For example, the regulation unit 30 and the second resistance circuit 403 are provided with similar structures as its counterparts illustrated in FIGS. 3 and 6, so that the corresponding description is accordingly omitted for conciseness consideration.

The first resistance unit 401 is different from the first resistance unit 201' illustrated in FIGS. 3 and 6 in that the fourth resistance subunit Rb2 is replaced with a fifth resistance subunit Rb3, a sixth resistance subunit 4, and switch 401*b*. For example, one of the switches 401*a* and 401*b* can be controlled by the enabled control signal ACTD, while the other one of the switches 401*a* and 401*b* are left turned off, i.e. an open circuit, for all the time of the enabled control signal ACTD.

In detail, when the switch 401*a* is provided with the control signal ACTD, the switch 401*b* is accordingly left turned off. Thus, the first resistance Rx1 of the first resistance unit 401 selectively corresponds to the sum of the third, the fifth, and the sixth resistance subunits Rb1, Rb3, and Rb4, in response to the disabled control signal ACTD, and corresponds to the resistance of the third resistance subunit Rb1, in response to the enabled control signal ACTD.

On the other hand, when the switch 401*b* is provided with control signal ACTD, the switch 401*a* is accordingly left turned off. Thus, the first resistance Rx1 of the first resistance unit 401 selectively corresponds to the sum of the third, the fifth, and the sixth resistance subunits Rb1, Rb3, Rb4, in response to the disabled control signal ACTD, and corresponds to the sum of the third and the fifth resistance subunits Rb1 and Rb3, in response to the enabled control signal ACTD.

Based on the above, by selectively supplying the control signal ACTD to one of the two different switches 401*a* and 401*b*, the first resistance Rx1 of the first resistance unit 401 and the level of the output signal VO can be accordingly configured with different value settings.

Figure 9:
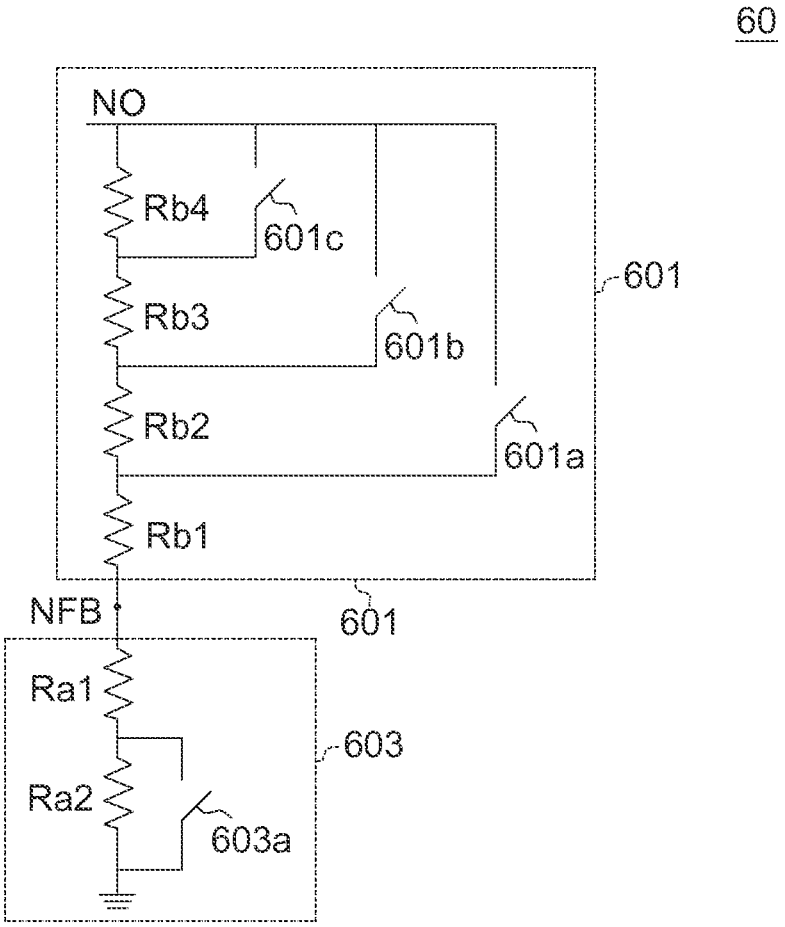
FIG. 9 is a circuit diagram of a feedback circuit according to the present embodiment of the invention.

Though only the situation that the voltage regulator is implemented as the circuit diagram of FIG. 8 is cited in the present embodiment of the invention, the voltage regulator is not limited thereto. In other example, the first resistance unit 601 of the feedback circuit 60 can also be designed to incorporate even more switches and even more resistance subunits, so that the output signal VO can also be selectively biased with different levels, as shown in FIG. 9.

For example: given a VREF and two tunable output signals VO, 2.0*VREF and 2.2*VREF, are desired. By utilizing the feedback circuit of FIG. 9, the required first resistance unit and second resistance unit are listed as follows:

| | Output Signal | 2.0 * V REF | 2.2 * VREF |
|---|---|---|---|
| STB | First Unit | Rb1 + Rb2 + Rb3 = 1.0 | Rb1 + Rb2 + Rb3 + Rb4 = 1.2 |
| | Second Unit | Ra1 + Ra2 = 1.0 | Ra1 + Ra2 = 1.0 |
| ACT | First Unit | Rb1 = 0.1 | Rb1 + Rb2 = 0.12 |
| | Second Unit | Ra1 = 0.1 | Ra1 = 0.1 |

And the normalized resistance of each resistor in FIG. 9 could be derived as follows: Ra1=0.1, Ra2=0.9, Rb1=0.1, Rb2=0.02, Rb3=0.88, Rb4=0.2. For the case of 2.0*VREF, switch 601*a* and 603*a* are enabled at ACT mode and only switch 601*c* is enabled at STB mode. For the case of 2.2*VREF, however, switch 601*b* and 603*a* are enabled at ACT mode but none is enabled at STB mode.

As the first resistance unit 601 is concerned, any combination of the switches 601*a* to 601*c* could selectively be provided with the control signal ACTD, be configured as being turned off, or even be configured as being turned on, in such a way that the sum of resistance subunits of the first resistance unit 601 in response to the disabled control signal ACTD is larger than that in response to the enabled control signal ACTD. As such, multiple possible configurations of first resistance unit 601 can be achieved. Similarly, other kinds of configuration of the first resistance unit 601, e.g. employing four or more than four switches and five or more than five resistance subunits, can also be obtained with analogized modification.

Figure 10:
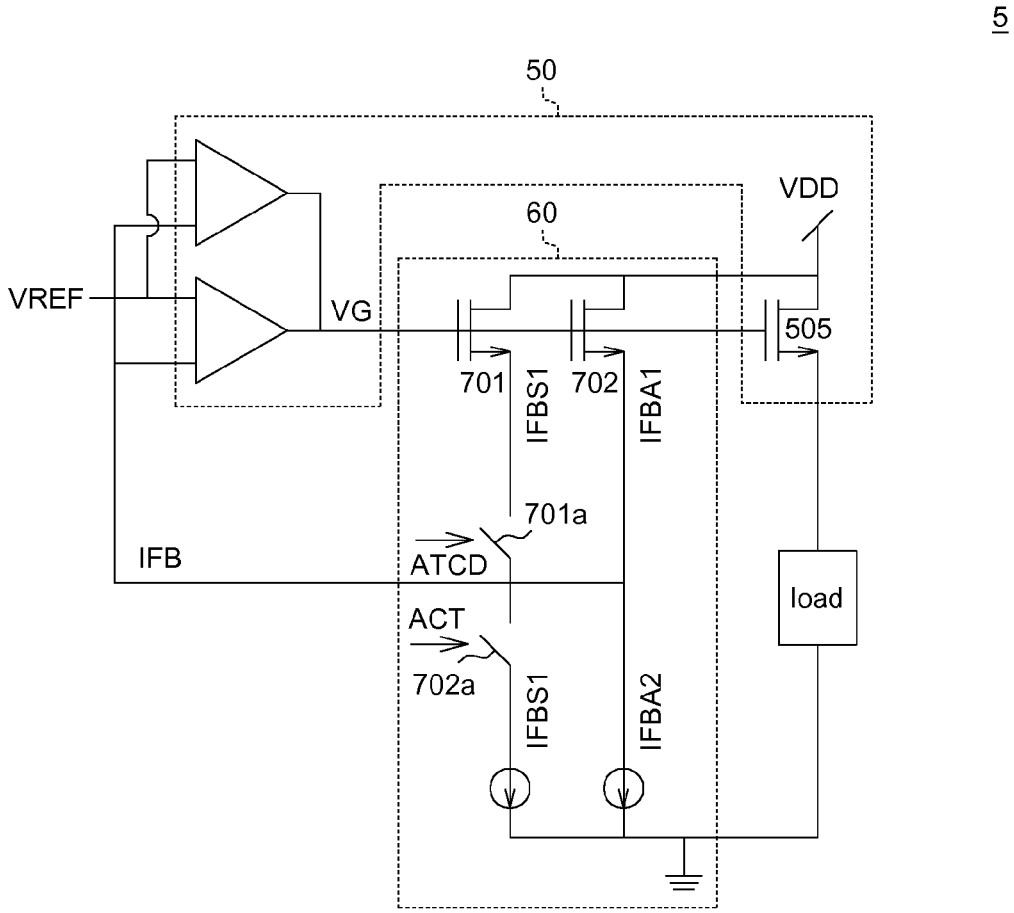
FIG. 10 is another circuit diagram of a voltage according to the present embodiment of the invention.

Though only the situations that the voltage regulator is implemented as the circuit diagrams of FIGS. 1, 3, and 6 are cited as examples illustrated in the above embodiments, the voltage regulator according to the present embodiment of the invention is not limited thereto. In other example, the feedback circuit can also be implemented with a circuit structure achieving the negative feedback operation by means of feeding back current feedback signals, rather than voltage signal VFB, as show in FIG. 10.

In detail, the feedback circuit 60 includes current mirrors 701 and 702 for respectively provide first feedback current If1 and second feedback current If2, by means of mirroring the current provided by the output driver 505. The feedback circuit 60 further includes switches 701*a* and 702*a* for selectively having the first feedback current If1 fed back to the regulation unit 50. In other words, the feedback circuit 60 can also be implemented with the current feedback structure.

Figure 11:
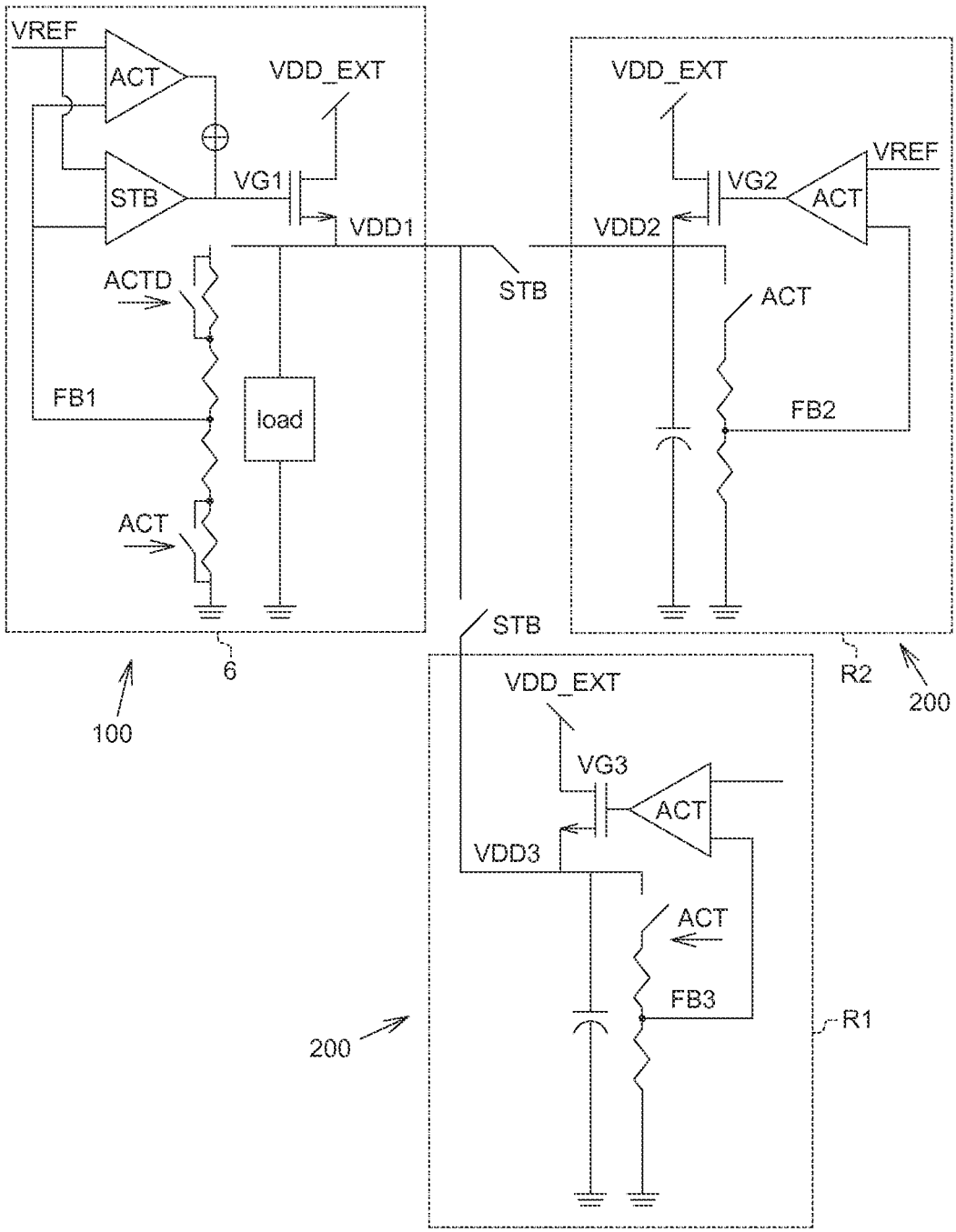
FIG. 11 is still another circuit diagram of a voltage according to the present embodiment of the invention.

In other example, the voltage regulators 1-3 could also employed for achieving power regulation across different VDD domains, as shown in FIG. 11. In detail, the voltage regulators 6 is employed for powering up the VDD domain 100, where the voltage regulator 6 is situated, so that the voltage regulators 6 is capable of providing the VDD signal VDD1 individually in the active mode. Also, in the active mode, the voltage regulators R2 and R1 are individually regulates the VDD signal VDD2 at VDD domain 200 and the VDD signal VDD3 at VDD domain 300, respectively.

While the load circuits of the VDD domains 100, 200 and 300 operate in the standby mode, the regulator R1 and R2 are disabled for saving power and the voltage regulator 6 is switched to standby mode and the VDD signal VDD1 at VDD domian100 is coupled to the VDD signals VDD2 and VDD3 at VDD domain 200 and 300 for providing voltage regulation.

While the invention has been described by way of example and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A voltage regulator, alternatively operating in an active mode in response to an enabled mode indication signal, and operating in a standby mode in response to the disabled mode indication signal, the voltage regulator comprising:

an output node;

a regulation unit, coupled to the output node and accordingly driving the output node with an output signal; and a feedback circuit, comprising:

a feedback node, providing a feedback signal;

a first resistance unit, connected between the output node and the feedback node, and configured with a first resistance; and a second resistance unit, connected between the feedback node and a ground reference voltage, and configured with a second resistance, corresponding to a first value in response to the disabled mode indication signal, wherein, the second resistance is further corresponding to a second value, smaller than the first value, in response to the enabled mode indication signal, so that a level dip event of the feedback signal, due to a sudden resistance decline of the second resistance, takes place when the disabled mode indication signal is switched to the enabled mode indication signal; and the first resistance corresponds to a third value and a fourth value in response to a control signal, wherein the regulation unit enhances drivability of the output signal in response to the level dip event of the feedback signal, so that transition period of the voltage regulator from the standby mode to the active mode is accordingly reduced due to enhanced drivability of the regulation unit and reduced resistance presented on the output node.

2. The voltage regulator according to claim 1, wherein the first resistance is corresponding to the third value in response to a disabled control signal, and corresponding to the fourth value, smaller than the third value, in response to the enabled control signal.

3. The voltage regulator according to claim 2, wherein the disabled control signal is switched to the enabled control signal after the disabled mode indication signal is switched to the enabled mode indication signal, wherein the control signal is obtained by having the mode indication signal delayed.

4. The voltage regulator according to claim 2, wherein the first resistance unit comprises:

a first intermediate node;

a first resistance subunit, coupled between the first intermediate node and the feedback node;

a second resistance subunit, coupled between the output node and the first intermediate node;

a first switch, coupled across the second resistance subunit, the first switch turned on in response to the enabled control signal, and turned off in response to the disabled control signal.

5. The voltage regulator according to claim 2, wherein the first resistance unit further comprises:

a first node and a second intermediate node;

a first resistance subunit, coupled between the first intermediate node and the feedback node;

a second resistance subunit, coupled between the first and the second intermediate nodes;

a third resistance subunit, coupled between the second intermediate node and the output node;

a first switch, coupled between the first intermediate node and the output node; and a second switch, coupled between the second intermediate node and the output node, wherein, the first and second switches are controlled with the enabled control signal and the disabled control signal in such a way that the equivalent resistance of the first resistance unit in response to the disabled control signal is larger than the equivalent resistance of the first resistance unit in response to the enabled control signal.

6. The voltage regulator according to claim 5, wherein, one of the first and the second switches is turned on in response to the enabled control signal, and one of the first and the second switches is turned off in response to the disabled control signal, so that the equivalent resistance of the first resistance unit in response to the disabled control signal is larger than the equivalent resistance of the first resistance unit in response to the enabled control signal.

7. The voltage regulator according to claim 2, wherein the first resistance unit further comprises:

a first to third intermediate nodes;

a first resistance subunit, coupled between the first intermediate node and the feedback node;

a second resistance subunit, coupled between the first and the second intermediate nodes;

a third resistance subunit, coupled between the second and the third intermediate nodes;

a fourth resistance subunit, coupled between the third intermediate node and the output node;

a first switch, coupled between the first intermediate node and the output node;

a second switch, coupled between the second intermediate node and the output node; and a third switch, coupled between the third intermediate node and the output node, wherein, the first to the third switches are controlled with the enabled control signal and the disabled control signal in such a way that the equivalent resistance of the first resistance unit in response to the disabled control signal is larger than the equivalent resistance of the first resistance unit in response to the enabled control signal.

8. The voltage regulator according to claim 7, wherein one of the first to the third switches is turned on and the other two of the first to the third switches are turned off, in response to the enabled control signal, and one of the first to the third switches is turned on in response to the disabled control signal.

9. The voltage regulator according to claim 7, wherein one of the first to the third switches is turned on and the other two of the first to the third switches are turned off, in response to the enabled control signal, and the first to the third switches are turned off in response to the disabled control signal.

10. The voltage regulator according to claim 1, wherein the second resistance unit comprises:

an intermediate node;

a first resistance subunit, coupled between the feedback node and the intermediate node;

a second resistance subunit, two ends of which are respectively coupled to the intermediate node and receives the ground reference voltage; and a switch, coupled across the second resistance subunit, the switch turned on in response to the enabled mode indication signal, and turned off in response to the disabled mode indication signal.

11. The voltage regulator according to claim 1, wherein the regulation unit further comprises:

a drive node;

a secondary amplifier configured with a first drivability for driving the drive node in response to a feedback signal;

a primary amplifier configured with a second drivability, greater than the first drivability, for driving the drive node according to the feedback signal in response to the enabled mode indication signal; and an output driver coupled to the drive node and driven by a drive signal on the drive node to provide an output signal on the output node.

12. The voltage regulator according to claim 11, wherein the regulation unit further comprises:

a voltage clamp unit, coupled to the drive node for having the drive signal on the drive node clamped within a boundary voltage, wherein, the output driver is biased as being barely on and with limited current drivability, in response to the drive signal.

13. The voltage regulator according to claim 11, wherein the primary amplifier further comprises:

an differential amplifier unit, for driving the drive node according to the feedback signal; and a switch unit, having the differential amplifier unit coupled to the feedback node in response to the enabled mode indication signal, and having the differential amplifier unit disabled in response to the disabled mode indication signal.

14. A voltage regulation method, applied in a voltage regulator, which alternatively operates in an active mode in response to an enabled mode indication signal, and operates in a standby mode in response to the disabled mode indication signal, the voltage regulation method comprising:

providing a regulation unit, coupled to an output node and accordingly driving the output node with an output signal;

providing a feedback circuit, comprising a feedback node for providing the feedback signal, a first resistance unit, connected between the output node and the feedback node configured with a first resistance, and a second resistance unit, connected between the feedback node and a ground reference voltage and configured with a second resistance;

making the second resistance corresponding a first value in response to the disabled mode indication signal;

making the second resistance corresponding to a second value, smaller than the first value, in response to the enabled mode indication signal, so that a level dip event of the feedback signal takes place when the disabled mode indication signal is switched into the enabled mode indication signal due to a sudden resistance decline of the second resistance; and enhancing drivability of the output signal in response to the level dip event of the feedback signal by the regulation unit, so that wherein transition period of the voltage regulator from the standby mode to the active mode is accordingly reduced due to enhanced drivability of the regulation unit and reduced resistance presented on the output node;

wherein the first resistance is corresponding to a third value and a fourth value in response to a control signal.

* * * * *